US005668467A

United States Patent [19]

Pease

[11] Patent Number: 5,668,467

[45] Date of Patent: Sep. 16, 1997

[54] CURRENT REGULATOR HAVING START-UP CIRCUITRY WHICH IS TURNED OFF AFTER START-UP

[75] Inventor: Robert Allen Pease, San Francisco, Calif.

[73] Assignee: National Semiconductor Corporation, Santa Clara, Calif.

[21] Appl. No.: 390,093

[22] Filed: Feb. 17, 1995

[51] Int. Cl.[6] ..... G05F 3/30

[52] U.S. Cl. ..... 323/315; 323/901

[58] Field of Search ..... 323/281, 303, 323/312, 901, 314–315, 907; 327/539–541

[56] References Cited

U.S. PATENT DOCUMENTS

| | | | |
|---|---|---|---|
| 4,786,855 | 11/1988 | O'Neill et al. | 323/314 |
| 5,084,665 | 1/1992 | Dixon et al. | 323/281 |

OTHER PUBLICATIONS

National semiconductor Corporation, "LM117/LM317 3–Terminal Adjustable Regulator," Linear Databook 1, 1988 Edition, pp. 1–50 to 1–60.

National Semionductor Corporation, "LM117HV/LM317HV 3–Terminal Adjustable Regulator," Linear Databook 1, 1988 Edition, pp. 1–61 to 1–70.

National Semiconductor Corporation, "LM131A/LM131, LM231A/LM231, LM331A/LM331 Precision Voltage–to–Frequency Converters," Linear Databook 2, 1988 Edition, pp. 3–285 to 3–295.

National Semiconductor Corporation, "LM34/LM34A/LM34C/LM34CA/LM34D Precision Fahrenheit Temperature Sensors", Data Acquisition Linear Devices Databook, 1989 Edition, pp. 6–4 to 6–11.

National Semiconductor Corporation, "LM35/LM35A/LM35C/LM35CA/LM35D Precision Centigrade Temperature Sensors," Data Acquisition Linear Devices Databook, 1989 Edition, pp. 6–12 to 6–20.

National Smiconductor Corporation, "LM135/LM235/LM335, LM135A/LM235A/LM335A Precision temperature Sensors," Data Acquisition Linear Devices Databook, 1989 Edition, pp. 6–21 to 6–29.

National Semiconductor Corporation, "LM3911 Temperature Controller," Data Acquisition Linear Devices Databook, 1989 Edition, pp. 6–30 to 6–36.

National Semiconductor Corporation, "LM122/LM322/LM2905/LM3905 Precision Timers," Linear Databook 3, 1988 Edition, pp. 5–7 to 5–18.

National Semiconductor Corporation, "NSC LM35 Schematic Diagram", Date Unknown, p. 1.

Alan b. Grebene, *Bipolar and MOS Analog Integrated Circuit Design*, John Wiley & Sons, Inc. (1984) pp. 189–193, 497–509.

*Primary Examiner*—Peter S. Wong
*Assistant Examiner*—Aditya Krishnan
*Attorney, Agent, or Firm*—Limbach & Limbach

[57] ABSTRACT

A current regulator includes a regulation stage and a start-up stage. The regulation stage has a base bus and an output transistor having a base coupled to the base bus for generating a regulated current. The regulation stage also includes a current maintaining transistor coupled to the base bus for inducing and maintaining an operating current in the base bus in response to a start-up current first being induced in the base bus. The start-up stage includes a start-up transistor coupled to the base bus for inducing the start-up current in the base bus before the current maintaining transistor is turned on. The start-up transistor is turned off by the regulation stage after the current maintaining transistor is maintaining the operating current in the base bus. A method of starting-up a regulator circuit includes the steps of: establishing a base bus; inducing a start-up current in the base bus; inducing an operating current in the base bus; establishing a conduction path between an emitter of a current maintaining transistor and an emitter of a start-up transistor; and gradually increasing a current which flows through the conduction path in order to gradually decrease a current conducted by the start-up transistor in order to turn the start-up transistor off.

19 Claims, 2 Drawing Sheets

CURRENT REGULATOR HAVING START-UP CIRCUITRY WHICH IS TURNED OFF AFTER START-UP

BACKGROUND OF THE INVENTION

1. Field of the Invention

The present invention relates to constant current sources and current regulators, and in particular, to a start-up circuit for use with such constant current sources and regulators.

2. Description of the Related Art

It is well known that self-biased circuits using internal feedback often require some type of start-up circuit to get the circuit started. Such start-up circuits are needed because most self-biased circuits have two stable operating points: one of them being the desired operating point at which the desired amount of current flows, and the other being an undesired zero-current state. Start-up circuits typically supply a small mount of start-up current to the circuit in order to eliminate the undesired zero-current state so that the circuit can get started and stabilize at the desired operating point.

Normally, if the start-up current is chosen to be very small, it will have a negligible effect on circuit operation. However, with the ever increasing precision required in modem circuits, the presence of the start-up current after the circuit has stabilized to the desired operating point can, in many situations, have a detrimental effect on circuit performance. For example, while the LM117 3-Terminal Adjustable Regulator manufactured by National Semiconductor Corporation of Santa Clara, Calif., provides acceptable performance, it does display operational shortcomings in some applications.

Specifically, after the LM117 has settled to its desired operating point, an increase in the input voltage will increase the start-up current, which continues to be supplied to the regulating portion of the circuit. An increase in the input voltage of +5 volts to +15 volts, will not detrimentally affect the performance of the regulator. However, an increase in the input voltage of +1.2 volts or +3 volts to +40 volts, as occurs in modem applications, can increase the start-up current enough to cause a significant change in the currents generated by the current mirror circuitry in the regulating portion of the circuit, thus detrimentally affecting the performance of the regulator. This example illustrates that a start-up circuit for a current regulator is particularly difficult to design because variations in the start-up current supplied to current mirror circuitry can cause fluctuations in the regulated currents.

Thus, there is a need for a current regulator having a start-up circuit which will not degrade the performance of the regulator.

SUMMARY OF THE INVENTION

The present invention provides a current regulator having a regulation stage and a start-up stage. The regulation stage includes a base bus and an output transistor having a base coupled to the base bus for generating a regulated current. The regulation stage also includes a current maintaining transistor coupled to the base bus for inducing and maintaining an operating current in the base bus in response to a start-up current first being induced in the base bus. The start-up stage includes a start-up transistor coupled to the base bus for inducing the start-up current in the base bus before the current maintaining transistor is turned on. The start-up transistor is turned off by the regulation stage after the current maintaining transistor is maintaining the operating current in the base bus.

The present invention also provides a method of starting-up a regulator circuit. The method includes the steps of: establishing a base bus; inducing a start-up current in the base bus with a start-up transistor which conducts a first current; inducing an operating current in the base bus with a current maintaining transistor which conducts a second current in response to the start-up current first being induced in the base bus; establishing a conduction path between an emitter of the current maintaining transistor and an emitter of the start-up transistor; and, gradually increasing the second current conducted by the current maintaining transistor in order to gradually increasing a third current which flows through the conduction path in order to gradually decrease the first current conducted by the start-up transistor in order to turn the start-up transistor off.

A better understanding of the features and advantages of the present invention will be obtained by reference to the following detailed description of the invention and accompanying drawings which set forth an illustrative embodiment in which the principles of the invention are utilized.

DETAILED DESCRIPTION OF THE PREFERRED EMBODIMENT

Figure 1:
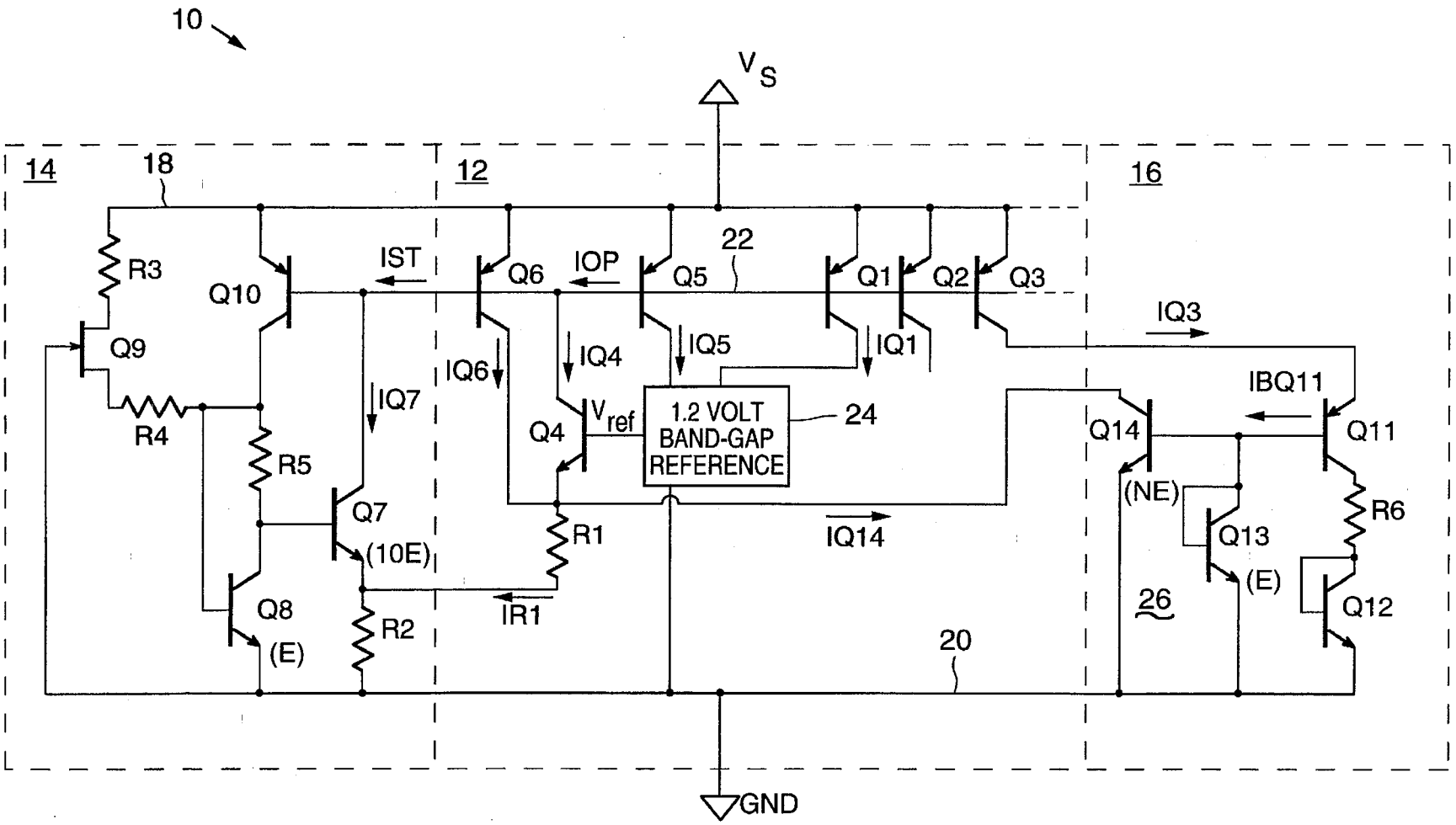
FIG. 1 is schematic diagram illustrating a current regulator in accordance with the present invention.

FIG. 1 illustrates a current regulator 10 in accordance with the present invention. It should be understood that the current regulator 10 may be used by itself to generate regulated currents, or it may be used as a building block for a variety of other circuit applications. For example, the current regulator 10 may be used in constructing voltage regulators, voltage-to-frequency converters, centigrade temperature sensors, or any other application requiring instrument grade regulated currents.

The current regulator 10 includes a regulator stage 12, a start-up stage 14, and an optional beta compensation stage 16. In the regulator stage 12 and the start-up stage 14, a main voltage bus 18 is coupled to a voltage supply VS. The voltage supply VS may be, for example, the input voltage of a voltage regulator in which the current regulator 10 is incorporated. A ground bus 20 runs through the regulator stage 12, the start-up stage 14, and the beta compensation stage 16.

The regulation stage 12 includes a base bus 22 to which the bases of several pnp output transistors Q1, Q2, and Q3 are coupled. An npn current maintaining transistor Q4 has its collector coupled to the base bus 22 and its emitter coupled to a resistor R1. Resistor R1 preferably has a value of 50 K Ω. Current is provided to the base of the current maintaining transistor Q4 by a 1.25 volt band-gap reference source 24. The reference source 24 receives current via a pnp transistor Q5 having its base coupled to the base bus 22, as well as transistor Q1 having its base coupled to the base bus 22. A pnp feedback transistor Q6 has its base coupled to the base bus 22 and its collector coupled to the emitter of the current maintaining transistor Q4. The emitters of transistors Q1, Q2, Q3, Q5, and Q6 are coupled to the main voltage bus 18 so that they form a multiple output current mirror.

The start-up stage 14 includes an npn start-up transistor Q7 having its collector coupled to the base bus 22 and its emitter coupled to a resistor R2. The emitter of the start-up transistor Q7 is also coupled to resistor R1. The base of the start-up transistor Q7 is coupled to the collector of an npn transistor Q8. The area of the emitter of the start-up transistor Q7 is approximately ten times greater than the area of the emitter of transistor Q8. The start-up transistor Q7 and transistor Q8 can receive current in two ways. First, an epitaxial resistor Q9, or EPI-FET Q9, feeds current to the base of transistor Q8 through resistors R3 and R4, all connected substantially as shown. Second, a pnp transistor Q10 having its base coupled to the base bus 22 feeds current through resistor R5 to the collector of transistor Q8 and the base of the start-up transistor Q7. Resistor R2 preferably has a value of either 54 KΩ or 60 KΩ. The values of resistors R3, R4, and R5 may be, for example, 1KΩ, 1KΩ, and 2.5KΩ, respectively; these values may, however, be changed depending upon the particular application.

In order to describe the operation of the current regulator 10, it is assumed that the power supply VS is initially 0 volts, resulting in the 1.25 volt reference source 24 output voltage Vref being 0 volts, and no current flowing in the circuit. As the power supply VS increases, the epitaxial resistor Q9 feeds current to transistor Q8. Transistor Q8 turns on which turns on the start-up transistor Q7. The start-up transistor Q7 conducts a current IQ7 which induces a start-up current IST in the base bus 22. When the start-up current IST is induced in the base bus 22, transistors Q1, Q2, Q3, QS, Q6, and Q10 all turn on.

The start-up current IST causes transistors Q1 and Q5 to conduct the currents IQ1 and IQ5, respectively. This causes the reference source 24 output voltage Vref to begin to rise up, and thus, begin to supply current to the base of the current maintaining transistor Q4. Meanwhile, transistor Q10 supplies enough current to transistor Q8 to keep the start-up transistor Q7 turned on. At this point in the start-up process, the start-up transistor Q7 is still the only source of current in the base bus 22. Because the start-up transistor Q7 remains turned on during this period, the rest of the regulator stage 12 continues to turn on. Furthermore, the start-up transistor Q7 remains turned on during this period whether the current conducted by the EPI-FET Q9 is large or small due to variations in the power supply VS or the channel width of the EPI-FET Q9, i.e., whether the current is 0.1, 1.0, 10.0 μA, etc.

As long as the reference source 24 output voltage Vref is less than 0.7 volts the current maintaining transistor Q4 will remain turned off. However, the current IQ5 causes the output voltage Vref to continue to rise. When the reference source 24 output voltage Vref rises to 0.7 volts, the current maintaining transistor Q4 turns on. The current maintaining transistor Q4 conducts a current IQ4 which induces an operating current IOP in the base bus 22. The presence of the operating current IOP, along with the start-up current IST, helps the regulator stage 12 turn on faster.

As the reference source 24 output voltage Vref rises, the current applied to the base of the current maintaining transistor Q4 increases which increases the current IQ4. When the reference source 24 output voltage Vref rises all the way up to 1.25 volts, the regulator stage 12 is fully turned on. The current maintaining transistor Q4 continues to conduct the current IQ4 which maintains the operating current IOP in the base bus 22. The operating current IOP alone is enough to keep all of the output transistors Q1, Q2, and Q3 turned on so that the collectors of the output transistors Q1, Q2, and Q3 can provide the regulated currents. Thus, the start-up current IST has done its job in getting the regulator stage 12 started, but it is no longer needed to maintain the regulator stage 12 at its desired operating point.

Once the reference source 24 output voltage Vref has risen all the way up to 1.25 volts, the voltage divider formed by resistors R1 and R2 turns the start-up transistor Q7 off. Specifically, as the current IQ4 gradually increases with the increasing voltage Vref, the current IR conducted by resistor R1 also gradually increases. As the current IR1 gradually increases, it gradually "steals" the current IQ7 conducted by the start-up transistor Q7. About the time that the reference source 24 output voltage Vref reaches 1.25 volts, the current IR1 has stolen all of the current IQ7 which turns off, or disables, the start-up transistor Q7. Once the start-up transistor Q7 is turned off, the start-up current IST is no longer induced in the base bus 22, and the regulator stage 12 continues to operate at its desired operating point based on the operating current IOP alone. Because the currents IQ4 and IR1 increase in a smooth and gradual manner, the start-up transistor Q7 turns off smoothly and gradually.

The initial value of the current IQ7 might be larger than or smaller than the final value of the current IQ4 when the start-up operation is completed. However, transistor Q4 insures that the current IQ6 is correct, despite large or small values of the currents IQ7 or IQ4.

By removing the start-up current IST, excessive base drive to the base bus 22 is avoided. Specifically, no matter how much current the EPI-FET Q9 conducts, it will not affect the amount of current conducted by transistors Q1, Q2, Q3, Q5, Q6, and Q10 because the start-up transistor Q7 gets turned off. The regulated currents provided by the output transistors Q1, Q2, and Q3 will not be affected by fluctuations in the power supply VS because the start-up current IST has been turned off. Therefore, the precision of the regulated currents provided by the regulator stage 12 is much improved over prior art regulators in which the start-up current is continually supplied to the regulator portion of the circuit even after the circuit had reached its desired operating point.

The purpose of the feedback transistor Q6 is to control the output transistors Q1, Q2, and Q3. Specifically, the feedback transistor Q6 is forced to conduct current so that the output transistors Q1, Q2, and Q3 do the same through the current mirror action. It should be understood that, while only the three output transistors Q1, Q2, and Q3 are shown in FIG. 1, additional output transistors could be added, or some could be removed, in order to increase or reduce, respectively, the number of regulated currents provided. Furthermore, one or more of the output transistors Q1, Q2, and Q3 could be replaced with a split-collector pnp transistor, i.e., a transistor having more than one collector, in order to increase the number of regulated currents provided.

The beta compensation stage 16, which is an optional feature of the current regulator 10, includes a pnp transistor Q11 having its emitter coupled to the collector of output transistor Q3. A resistor R6 and a diode connected npn transistor Q12 are coupled to the collector of transistor Q11 substantially as shown. The base of transistor Q11 is coupled to a current mirror 26 formed from a diode connected npn transistor Q13 and an npn transistor Q14. The collector of transistor Q14 is coupled to the emitter of current maintaining transistor Q4. As will be discussed below, the area of the emitter of transistor Q4 is N times greater than the area of the emitter of transistor Q13.

The purpose of the beta compensation stage 16 is to compensate the current IR1 in the event that the output transistors Q1, Q2, and Q3 have a low beta β. Specifically, after the start-up current IST has been turned off, the current IQ4 is the sum of all of the base currents of transistors Q1, Q2, Q3, Q5, Q6, and Q10. If the beta 13 of the output transistors Q1, Q2, and Q3 is very high, then the current IQ4 will remain fairly small due to the small base currents of the output transistors Q1, Q2, and Q3. However, if the beta β of the output transistors Q1, Q2, and Q3 is poor, i.e., small, then the current IQ4 may become rather large, especially if many more output transistors are added. If the current IQ4 becomes large, then the current IQ6 conducted by the collector of transistor Q6 will be decreased, which is undesirable. The desired operating state for good current regulation is to have the current IR1 be approximately equal to the current IQ6. Thus, whether or not the beta compensation stage 16 is used will depend on the number of output transistors used and the value of their betas β.

During operation of the beta compensation stage 16, the regulated current IQ3 conducted by output transistor Q3 is fed into the emitter of transistor Q11. The base current IBQ11 generated by transistor Q11 is approximately proportional to the current IQ4 conducted by the current maintaining transistor Q4. The current IBQ11 is then fed into the current mirror 26 where it is amplified by a gain of N. Amplification occurs because the area of the emitter of transistor Q14 is N times greater than the area of the emitter of transistor Q13. The number N is approximately equal to the number of transistors having their bases connected to the base bus 22, in this case 6, i.e., transistors Q1, Q2, Q3, Q5, Q6, and Q10. With a gain of approximately N=6, the amplified current IQ14 conducted by transistor Q14 will substantially cancel out the current IQ4 conducted by the current maintaining transistor Q4. In other words, if the current IQ14 is made approximately equal to the current IQ4, then the current IR1 will be approximately equal to the current IQ6 conducted by transistor Q6, as is desired. It should be well understood that the number N will vary depending upon the amount of compensation needed, and N may or may not be equal to the number of transistors coupled to the base bus 22.

Given that the voltage at the emitter of the current maintaining transistor Q4 is equal to VEQ14, the current IR1=VEQ4/(R1+R2). Due to the current IQ14, the current IR1 will be well compensated for poor beta β, as well as for variations in the voltage supply VS. Furthermore, the current IR1 will be approximately proportional to absolute temperature as desired.

Figure 2:
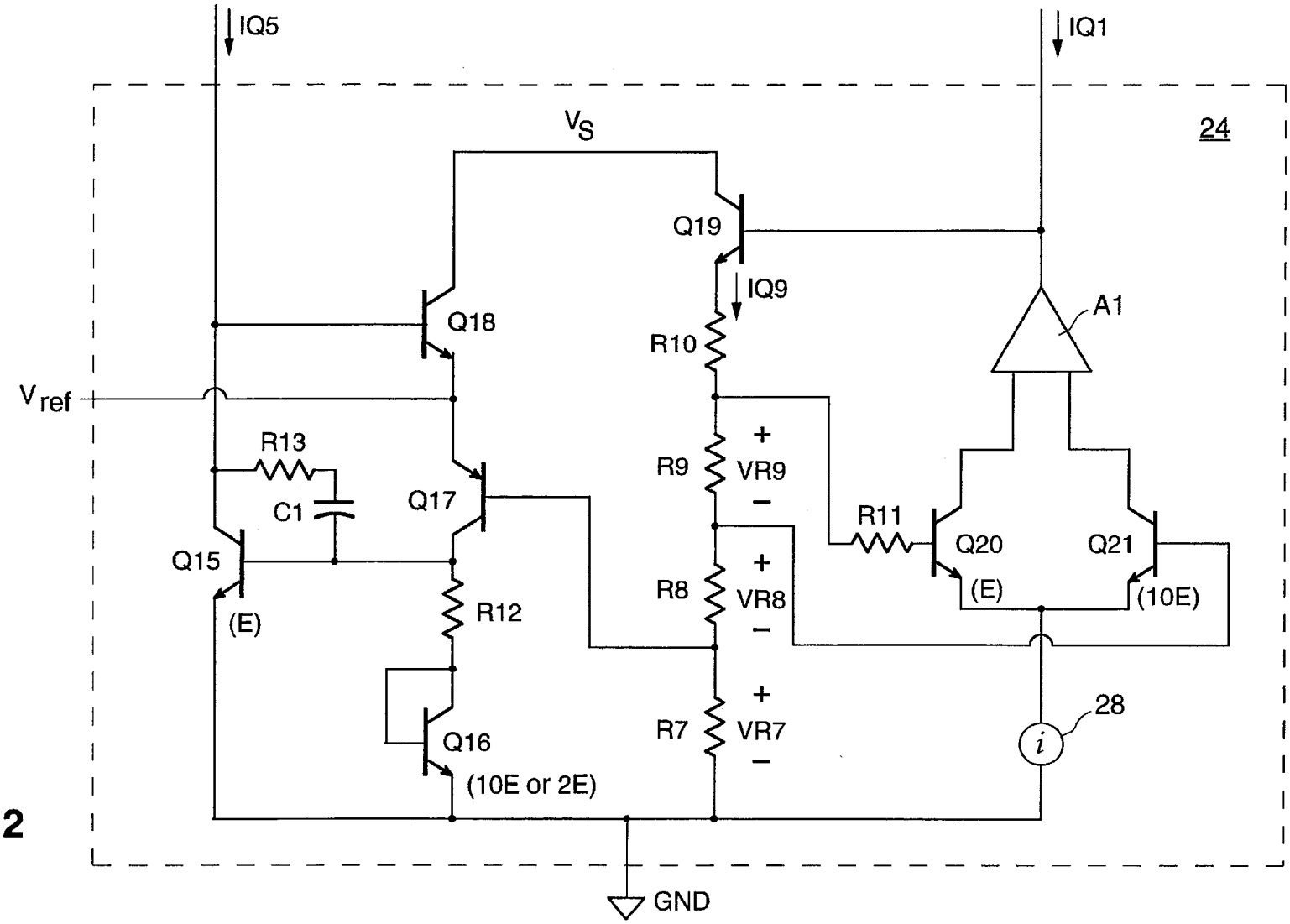
FIG. 2 is a schematic diagram illustrating the band-gap reference voltage source shown in FIG. 1.

Referring to FIG. 2, an example of a circuit which may be used for the 1.25 volt band-gap reference source 24 includes npn transistors Q15, Q16, Q18, Q19, Q20, Q21, and pnp transistor Q17, all connected substantially as shown. Preferably, the area of the emitter of transistor Q16 is two to ten times greater than the area of the emitter of transistor Q15, and the area of the emitter of transistor Q21 is ten times greater than the area of the emitter of transistor Q20. The resistors R7, R8, R9, R10, R11, R12, and R13 preferably have values of 98.2KΩ, 91KΩ, 10KΩ, 200Ω, 8KΩ, 120KΩ, and 2Ω, respectively, and the capacitor C1 preferably has a value of 2 pf. The current source 28 generates an approximately 4 μA current.

As mentioned above, the reference source 24 is started when the start-up current IST causes transistors Q1 and Q5 to conduct the currents IQ1 and IQ5, respectively. It should be noted that only a small start-up current IST is needed to start the reference source 24. The current IQ1 turns on transistor Q19 which conducts the current IQ9 through the resistors R7, R8, R9, and R10. This causes the voltage VR9 across resistor R9 to rise. The voltage VR9 rises until it reaches approximately 60 mV (at room temperature). The voltage VR9=60 mV due to the equation V=(kT/q)1n10, where 10 is the ratio of the size of the emitter of transistor Q21 to the size of the emitter of transistor Q20, as is well known in the art.

The operational amplifier A1 and transistor Q19 regulate the voltage VR9. Because the voltage VR9 is regulated, the voltages VR8 and VR7 across resistors R8 and R7, respectively, are also regulated. In other words, each of the voltages VR8 and VR7 is proportional to VR9=IQ9(R9). Because the voltage VR9 is proportional to absolute temperature, the voltages VR8 and VR7 are also proportional to absolute temperature. The voltage VR7 has a positive temperature coefficient which causes it to rise linearly as temperature increases. Conversely, the base-emitter voltage VBE of transistor Q17 has a negative temperature coefficient which causes it to decrease as temperature increases. This results in the reference voltage Vref, which is equal to the emitter voltage of transistor Q17, being equal to 1.25 volts and having a low temperature coefficient as is desired.

It should be understood that various alternatives to the embodiments of the invention described herein may be employed in practicing the invention. It is intended that the following claims define the scope of the invention and that structures and methods within the scope of these claims and their equivalents be covered thereby.

What is claimed is:

1. A current regulator, comprising:

a regulation stage having a base bus and an output transistor having a base coupled to the base bus for generating a regulated current, the regulation stage having a current maintaining transistor coupled to the base bus for inducing and maintaining an operating current in the base bus in response to a start-up current first being induced in the base bus; and a start-up stage having a start-up transistor which conducts a first current and which is coupled to the base bus for inducing the start-up current in the base bus before the current maintaining transistor is turned on;

a first conductor which couples the current maintaining transistor to the start-up transistor and which conducts a second current; and a second conductor which couples the start-up transistor to ground and which conducts a third current which is substantially equal to a sum of the first and second currents;

wherein the regulation stage turns off the start-up transistor by gradually increasing the second current which gradually decreases the first current.

2. A current regulator as recited in claim 1, wherein the first conductor comprises:

a first resistor coupled between an emitter of the current maintaining transistor and an emitter of the start-up transistor;

wherein the current maintaining transistor conducts a fourth current in order to induce the operating current in the base bus, and the regulation stage gradually increases the second current by gradually increasing the fourth current.

3. A current regulator as recited in claim 2, wherein the regulation stage comprises:

a voltage reference source, coupled to a base of the current maintaining transistor and responsive to the start-up current in the base bus, which applies a fifth current to the base of the current maintaining transistor in response to the start-up current in order to gradually increase the fourth current.

4. A current regulator as recited in claim 1, wherein the second conductor comprises:

a second resistor coupled between the emitter of the start-up transistor and ground through which the third current flows.

5. A current regulator as recited in claim 1, further comprising:

a compensation circuit having a first transistor coupled to the output transistor which receives the regulated current and generates at its base a fourth current that is approximately proportional to a fifth current conducted by the current maintaining transistor, the compensation circuit amplifying the fourth current by a gain of N to produce an amplified fourth current and feeding the amplified fourth current to an emitter of the current maintaining transistor.

6. A current regulator as recited in claim 3, wherein the voltage reference source comprises:

a second resistor;

a voltage generation stage coupled to the second resistor which generates a regulated voltage across the second resistor in response to the start-up current being in induced in the base bus; and a first transistor for applying the fifth current to the base of the current maintaining transistor, a base of the first transistor being coupled to the voltage generation stage so that the regulated voltage turns on the first transistor.

7. A current regulator, comprising:

a base bus;

an output transistor having a base coupled to the base bus for generating a regulated current;

a start-up transistor coupled to the base bus which conducts a first current for inducing a start-up current in the base bus;

a current maintaining transistor coupled to the base bus which conducts a second current for inducing and maintaining an operating current in the base bus in response to the start-up current first being induced in the base bus;

a first resistor coupled between an emitter of the current maintaining transistor and an emitter of the start-up transistor through which a third current is induced by the second current conducted by the current maintaining transistor; and a second resistor coupled between the emitter of the start-up transistor and ground through which a fourth current equal to a sum of the first and third currents flows;

wherein the second current conducted by the current maintaining transistor gradually increases the third current which gradually decreases the first current conducted by the start-up transistor until the start-up transistor turns off.

8. A current regulator as recited in claim 7, further comprising:

a voltage reference source, coupled to a base of the current maintaining transistor and responsive to the start-up current in the base bus, which applies a fifth current to the base of the current maintaining transistor in response to the start-up current in order to gradually increase the second current.

9. A current regulator as recited in claim 7, further comprising:

a feedback transistor having a base coupled to the base bus and a collector coupled to the emitter of the current maintaining transistor for controlling the regulated current generated by the output transistor.

10. A current regulator as recited in claim 7, further comprising:

a main voltage bus; and an epitaxial resistor coupled to the main voltage bus for conducting a fifth current which is used to turn the start-up transistor on.

11. A current regulator as recited in claim 10, further comprising:

a first transistor coupled to receive a portion of the fifth current conducted by the epitaxial resistor and coupled to a base of the start-up transistor, the first transistor turning the start-up transistor on when the portion of the fifth current is received by the first transistor.

12. A current regulator as recited in claim 7, further comprising:

a first transistor coupled to the output transistor which receives the regulated current and generates at its base a fifth current that is approximately proportional to the second current conducted by the current maintaining transistor; and current mirror circuitry for amplifying the fifth current by a gain of N to produce an amplified fifth current, the current mirror circuitry being coupled to the emitter of the current maintaining transistor to feed the amplified fifth current thereto.

13. A current regulator as recited in claim 8, wherein the voltage reference source comprises:

a third resistor;

a voltage generation stage coupled to the third resistor which generates a regulated voltage across the third resistor in response to the start-up current being induced in the base bus; and a first transistor for applying the fifth current to the base of the current maintaining transistor, a base of the first transistor being coupled to the voltage generation stage so that the regulated voltage turns on the first transistor.

14. A method of starting-up a regulator circuit, comprising the steps of:

establishing a base bus;

inducing a start-up current in the base bus with a start-up transistor which conducts a first current;

inducing an operating current in the base bus with a current maintaining transistor which conducts a second current in response to the start-up current first being induced in the base bus;

establishing a first conduction path between an emitter of the current maintaining transistor and an emitter of the start-up transistor through which a third current is induced by the second current;

establishing a second conduction path between the emitter of the start-up-transistor and ground through which a fourth current equal to a sum of the first and third currents flows; and gradually increasing the second current conducted by the current maintaining transistor in order to gradually increase the third current in order to gradually decrease the first current conducted by the start-up transistor in order to turn the start-up transistor off.

15. A method as recited in claim 14, further comprising the step of:

applying a fifth current to a base of the current maintaining transistor in response to the start-up current in order to gradually increase the second current.

16. A method as recited in claim 14, further comprising the step of:

providing a feedback path between the base bus and the emitter of the current maintaining transistor.

17. A method as recited in claim 14, further comprising the step of:

conducting a fifth current with an epitaxial resistor which is used to turn the start-up transistor on.

18. A method as recited in claim 17, further comprising the step of:

turning the start-up transistor on when the portion of the fifth current conducted by the epitaxial resistor is received by a first transistor which is coupled to receive a portion of the fifth current and coupled to a base of the start-up transistor.

19. A method as recited in claim 14, further comprising the steps of:

generating a regulated current with an output transistor having a base coupled to the base bus;

generating a fifth current that is approximately proportional to the second current conducted by the current maintaining transistor from the regulated current;

amplifying the fifth current by a gain of N to produce an amplified fifth current; and feeding the amplified fifth current to the emitter of the current maintaining transistor.

* * * * *